US006471321B1

(12) United States Patent
Aono et al.

(10) Patent No.: US 6,471,321 B1
(45) Date of Patent: Oct. 29, 2002

(54) INK JET RECORDING APPARATUS AND INK JET RECORDING HEAD

(75) Inventors: Kiyomi Aono, Kawasaki; Akio Saito, Machida; Kenjiro Watanabe, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 09/640,586

(22) Filed: Aug. 18, 2000

(30) Foreign Application Priority Data

Aug. 23, 1999 (JP) ..... 11-235758

(51) Int. Cl.[7] ..... B41J 29/38
(52) U.S. Cl. ..... 347/14; 347/48; 347/60
(58) Field of Search ..... 347/14, 48, 11, 347/60, 10

(56) References Cited

U.S. PATENT DOCUMENTS

| | | | | |
|---|---|---|---|---|
| 4,746,935 A | 5/1988 | Allen | 346/140 R |
| 5,006,867 A | 4/1991 | Koizumi et al. | 346/140 R |
| 5,745,131 A | 4/1998 | Kneezel et al. | 347/15 |

FOREIGN PATENT DOCUMENTS

| | | | |
|---|---|---|---|
| EP | 719647 | * | 3/1996 |
| EP | 0 719 647 A3 | | 7/1996 |
| EP | 0 719 647 A2 | | 8/1996 |
| EP | 0 726 149 A | | 8/1996 |
| EP | 816085 | * | 1/1998 |
| EP | 0 816 085 A2 | | 1/1998 |
| EP | 0 819 533 A2 | | 1/1998 |
| EP | 0 924 085 A2 | | 6/1999 |
| JP | 355132259 | * | 10/1980 |
| JP | 63 209846 | | 8/1988 |

* cited by examiner

*Primary Examiner*—John Barlow
*Assistant Examiner*—Ly Tran
(74) *Attorney, Agent, or Firm*—Fitzpatrick, Cella, Harper & Scinto

(57) ABSTRACT

An ink jet recording apparatus includes an ink jet recording head provided with a discharge port for discharging ink, an ink flow path communicating with the discharge port, and at least two heat generating elements provided in the ink flow path along the direction thereof, wherein the ink is pigment-based ink and the recording head comprises drive signal supply means for varying the supply timing of drive signals to the plural heat generating elements for ink discharge in such a manner that the drive signal is at first given to the heat generating element at the side of the discharge port at room temperature and the supply timings to the plural heat generating members become simultaneous or closer thereto with an increase in the temperature of the recording head.

4 Claims, 17 Drawing Sheets

FIG. 22

〈DISCHARGE CHARACTER DATA OF COLOR INK & BLACK INK (PIGMENT, DYE)〉

| INK TYPE | | DISCHARGE AMOUNT (ng) | REFILL TIME (μs) | DISCHARGE SPEED (m/s) |
|---|---|---|---|---|
| COLOR INK | SMALL LIQUID DROPLET | 15.5 | 130 | 12 |
| | LARGE LIQUID DROPLET | 38.0 | 150 TO 160 | 17 |
| BLACK INK (PIGMENT) | SMALL LIQUID DROPLET | 38.0 | 160 TO 170 | 12 |
| | LARGE LIQUID DROPLET (FRONT HEATER IS SHIFTED BY 0.3 μs AT 23 °C) | 70.0 | 90 | 11 |
| | LARGE LIQUID DROPLET (SIMULTANEOUS DISCHARGE AT 30 °C) | 70.0 | 90 | 12 |
| BLACK INK (DYE) | SMALL LIQUID DROPLET | 38.0 | 180 | 12 |
| | LARGE LIQUID DROPLET | 69.0 | 200 | 17 |

INK JET RECORDING APPARATUS AND INK JET RECORDING HEAD

BACKGROUND OF THE INVENTION

1. Field of the Invention

The present invention relates to an ink jet recording apparatus and an ink jet recording head, for executing recording by discharging ink from an ink flow path depositing such ink onto a recording medium.

2. Related Background Art

Among various recording methods employed in the current recording apparatus such as a printer, the ink jet recording method is attracting attention because it is a non-impact recording method almost free from noises at the recording and capable of high-speed recording, and is widely employed as an effective recording method. Recently demand is increasing for color recording or high quality recording utilizing such ink jet recording method, and there is proposed a configuration enabling gradational representation by varying the dot size in order to achieve high image quality. For example there is known a configuration having plural heat generating elements in a liquid flow path and supplying the individual heat generating elements selectively with drive signals from a functional element circuit formed on a substrate, thereby varying the amount of the ink discharged per pixel and enabling gradational recording of an image. Also there is required to record the image with plural inks, resulting in an increase in the number of inks.

In case two or more inks are employed, the amount of the discharged ink and the time required by the vibration of the liquid meniscus to stabilize after ink discharge fluctuate depending on the kind of the ink. The refilling speed becomes no longer constant if the time required by the vibration of the liquid meniscus to stabilize fluctuates. However, in order to achieve recording of high image quality, it is necessary to obtain an appropriate ink discharge amount according to the kind of the ink and to obtain same discharge characteristics (refilling time, discharge speed etc.) regardless of the kind of the ink.

SUMMARY OF THE INVENTION

In consideration of the foregoing, the object of the present invention is to provide an ink jet recording apparatus and an ink jet recording head capable of satisfactory recording by realizing substantially constant discharge characteristics for all the liquid flow paths even if inks therein are different in the kinds.

The above-mentioned object can be attained, according to the present invention, by an ink jet recording apparatus equipped with an ink jet recording head provided with a discharge port for discharging ink, an ink flow path communicating with the discharge port, and at least two heat generating elements provided in the ink flow path along the direction thereof, wherein the ink is pigment ink and the recording head comprises drive signal supply means for varying the supply timing of drive signals to the plural heat generating elements for ink discharge in such a manner that the drive signal is at first given to the heat generating element at the side of the discharge port at room temperature and the supply timings at the plural heat generating members become simultaneous or closer thereto with an increase in the temperature of the recording head.

The drive signal may include a preliminary drive signal and a main drive signal.

After the supply timings at the plural heat generating elements become simultaneous with the increase in temperature, the drive signal supply means may reduce the pulse duration of the preliminary drive signal in response to a further increase in temperature.

The present invention is further featured by an ink jet recording apparatus equipped with an ink jet recording head provided with plural discharge ports for discharging ink, plural ink flow paths respectively communicating with the discharge ports, and at least two heat generating elements provided in each ink flow path along the direction thereof, the ink jet recording head comprising a pigment ink discharge portion for discharging pigment ink and a dye ink discharge portion for discharging dye ink, and the ink jet recording apparatus comprising drive signal supply means for varying the supply timing of drive signals for ink discharge to the plural heat generating elements of the pigment ink discharge portion in such a manner that the drive signal is at first given to the heat generating element at the side of the discharge port at room temperature and the supply timings at the plural heat generating members become simultaneous or closer thereto with an increase in the temperature of the recording head.

The drive signal may include a preliminary drive signal and a main drive signal.

After the supply timings at the plural heat generating elements become simultaneous with the increase in temperature, the drive signal supply means may reduce the pulse duration of the preliminary drive signal in response to a further increase in temperature.

The drive signals for ink discharge in the plural heat generating elements of the dye ink discharge portion may be supplied in succession in such a manner that the heat generating element at the side of the discharge port is given the drive signal later.

In the dye ink discharge portion, the supply timings of the drive signals for ink discharge in the dye ink supply portion need not be rendered variable.

The present invention is further featured by an ink jet recording apparatus capable of selectively mounting a first head provided with plural discharge ports for discharging ink, plural ink flow paths respectively communication with the discharge ports, and at least two heat generating elements provided in each ink flow path along the direction thereof and adapted to discharge pigment ink of a desired color, or a second head having a structure same as that of the first head and adapted to discharge dye ink of a color same as that of the pigment ink, the ink jet recording apparatus comprising ID recognition means for recognizing an ID provided on each head, and a ROM having a supply timing table, for each ID, for the drive signals for the ink discharge by the plural heat generating elements, wherein the supply timing table of the ROM is selected according to the ID recognized by the recognition means to vary the supply timings of the drive signals for ink discharge by the plural heat generating elements in each head according to the kind of the ink thereby discharging ink droplets of a substantially constant amount in each head.

The supply timings of the drive signals for the plural heat generating elements for discharging pigment ink are such that the drive signal is at first given to the heat generating element at the side of the discharge port, and the supply timings of the drive signals for the plural heat generating elements for discharging dye ink is such that the drive signal may be given later to the heat generating element at the side of the discharge port.

The first or second head may be capable of discharging ink of a color different from the desired color, and such ink of the different color may be of a same kind.

The ink jet recording apparatus may further comprise drive signal supply means for varying the supply timing of drive signals to the plural heat generating elements of the first head for ink discharge in such a manner that the drive signal is at first given to the heat generating element at the side of the discharge port at room temperature and the supply timings at the plural heat generating members become simultaneous or closer thereto with an increase in the temperature of the recording head.

The drive signal may include a preliminary drive signal and a main drive signal.

After the supply timings at the plural heat generating elements become simultaneous with the increase in temperature, the drive signal supply means may reduce the pulse duration of the preliminary drive signal in response to a further increase in temperature.

The present invention is further featured by an ink jet recording head provided with plural discharge ports for discharging ink, plural ink flow paths respectively communicating with the discharge ports, and at least two heat generating elements provided in each ink flow path along the direction thereof, the ink jet recording head comprising a ROM having a supply timing table for the drive signals for the ink discharge by the plural heat generating elements for compensating (correcting) the change in physical properties of the ink depending on the heat temperature, wherein the supply timings of the drive signals for ink discharge by the plural heat generating elements are varied according to the head temperature based on the supply timing table thereby discharging ink droplets of a substantially constant amount.

The present invention is further featured by a single ink jet recording head provided with plural discharge ports for discharging ink, a discharge port forming member provided with plural discharge ports, plural ink flow paths respectively communicating with the discharge ports, and a heat generating element provided in each ink flow path, the plural ink flow paths including an ink flow path in which ink of a different color is supplied, wherein the discharge port forming member has different thicknesses for the discharge ports for inks of different colors and has a boundary portion between the discharge ports for discharging the inks of the different colors and the thickness of the discharge port forming member is changed at such boundary portion.

The heat generating element may be provided in at least two units in the ink flow path along the direction thereof.

In the ink jet recording head, the discharge amount may be different for each ink color.

The present invention is further featured by a single ink jet recording head provided with plural discharge ports for discharging ink, a discharge port forming member provided with plural discharge ports, plural ink flow paths respectively communicating with the discharge ports, and at least two heat generating elements provided in each ink flow path along the direction thereof, the plural ink flow paths including an ink flow path in which ink of a different color is supplied and the discharge amount being different for each ink color, wherein the ink flow paths have a same length and a same height are different in at least one of the heat generating element, the width of the ink flow path and the thickness of the discharge port forming member for each ink color thereby attaining a desired discharge amount for each color of the ink to be discharged.

The above-described configurations provides advantages, in case of discharging plural inks of different kinds from a single head, of satisfying the discharge characteristics of each heater and obtaining satisfactory recording. Based on these advantages, it is rendered possible to maintain the shape of the common liquid chamber, the area of the hydrophilic area on the face bearing the discharge ports, the distance to the discharge port and the shape of the rear end of the ink flow path regardless of the kind of the ink, thereby achieving a reduction in the manufacturing process and in the manufacturing cost.

BRIEF DESCRIPTION OF THE DRAWINGS

FIG. 22 is a table showing the discharge characteristic data for color ink and black ink (pigment, dye);

DESCRIPTION OF THE PREFERRED EMBODIMENTS

Now the present invention will be clarified in detail by preferred embodiments thereof, with reference to the accompanying drawings.

[Embodiment 1]

Figure 1:
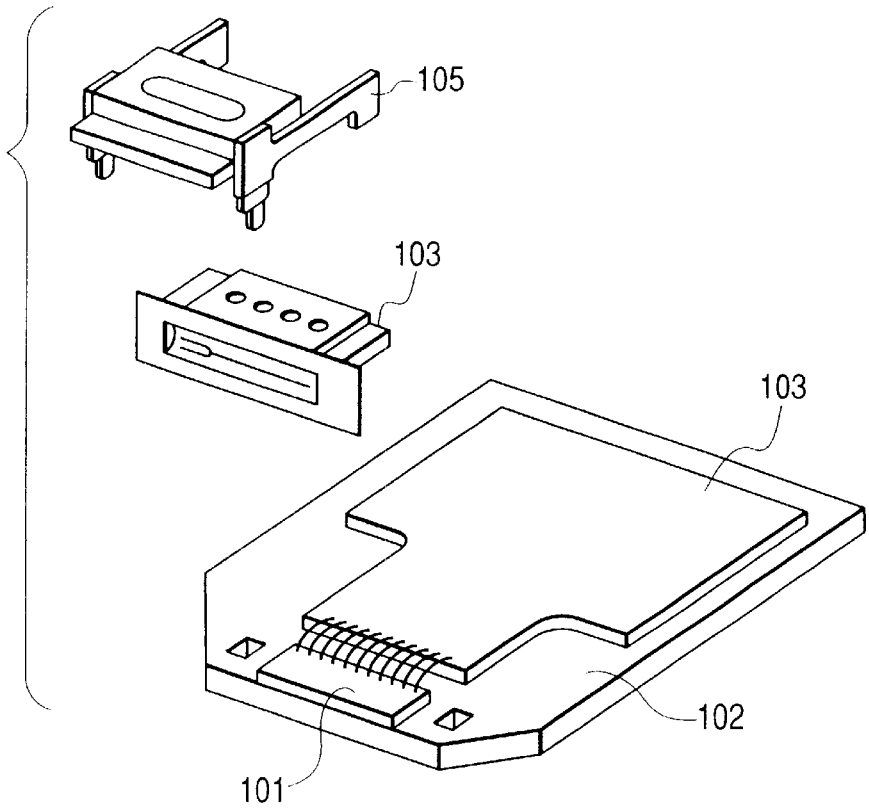
FIG. 1 is an exploded perspective view of an ink jet recording head of an embodiment 1 of the present invention.

FIG. 1 is an exploded perspective view of an ink jet recording head of the present invention, in which, on a base plate 102 bearing (mounting) an element substrate 101 and a wiring board 103, a grooved top plate 104 is laminated and fixed by a fixing member 105. Plural heat generating elements (discharge energy generation means) are provided on the element substrate 101 in such a manner that two heat generating elements are positioned in an ink flow path 202 to be explained later. The wiring board 103 is provided, though not explained in detail, with control means for selectively supplying the heat generating elements with drive signals, and the control means and the heat generating elements are connected through a wire connecting the wiring board 103 and the element substrate 101 and circuits formed in the element substrate 101.

Figure 2:
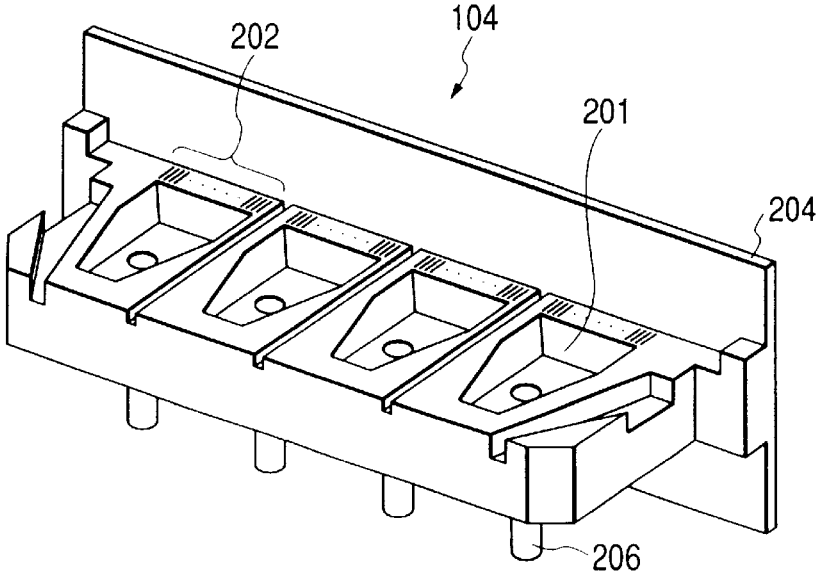
FIG. 2 is a perspective view of a grooved top plate in the ink jet recording head shown in FIG. 1.
Figure 3:
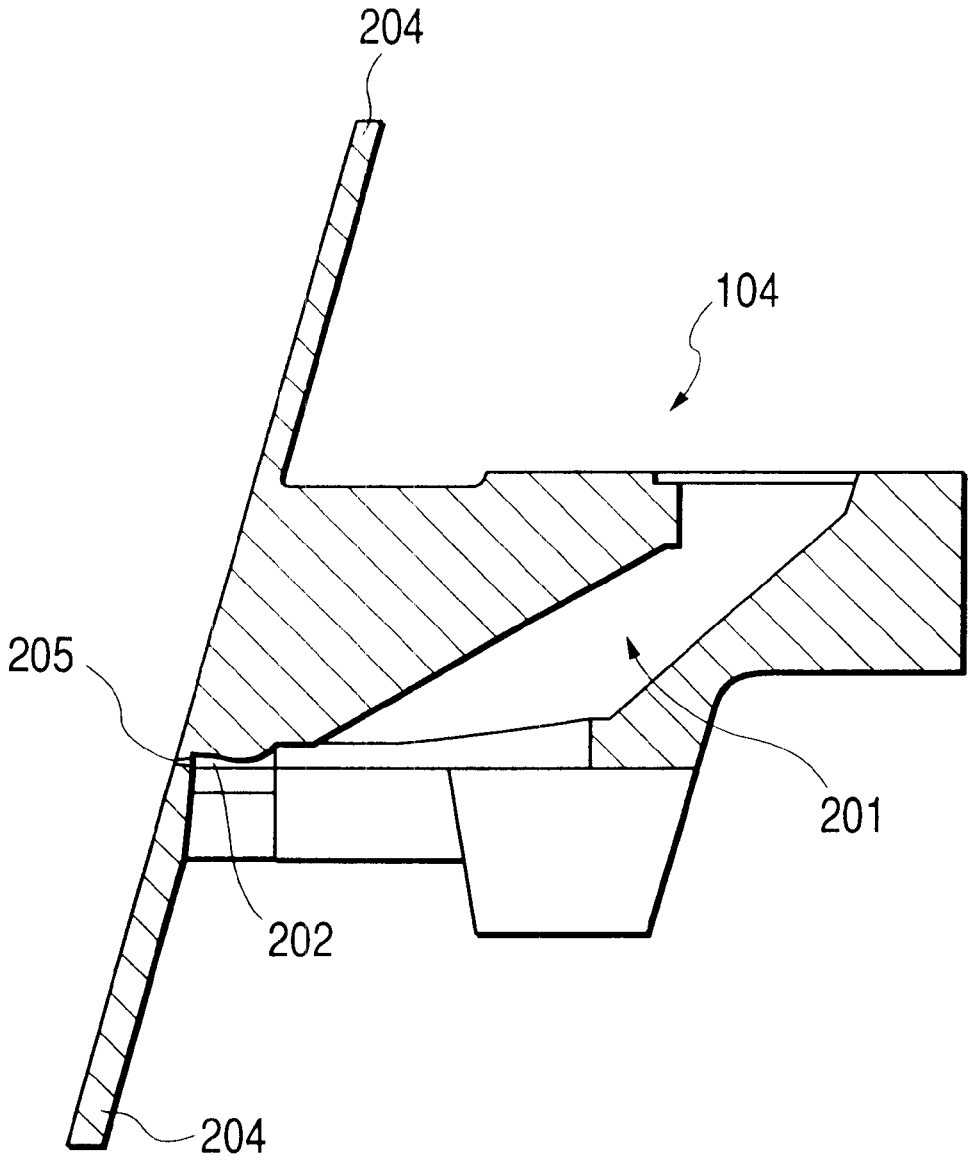
FIG. 3 is a cross-sectional view of the grooved top plate shown in FIG. 2.

FIG. 2 is a perspective view of the grooved top plate 104 seen from the bottom side thereof, and FIG. 3 is a cross-sectional view thereof. The ink jet recording head of the present embodiment is a color recording head capable of discharging inks of four colors, and the grooved top plate 104 is separated into four, corresponding to the respective colors. More specifically, there are provided, independently for each color, a common liquid chamber 201, an ink supply pipe 202 and plural ink flow paths 202 branching from the common liquid chamber 201. The grooved top plate 104 is integrally provided with an orifice plate 204 including plural discharge ports 205 respectively communicating with the ink flow paths 205 and adapted for discharging ink. The grooved top plate 104 is fixed to the element substrate 101 in such a manner that, in each ink flow path 202, two heat generating elements are positioned front and back with respect to the discharge port.

Figure 19:
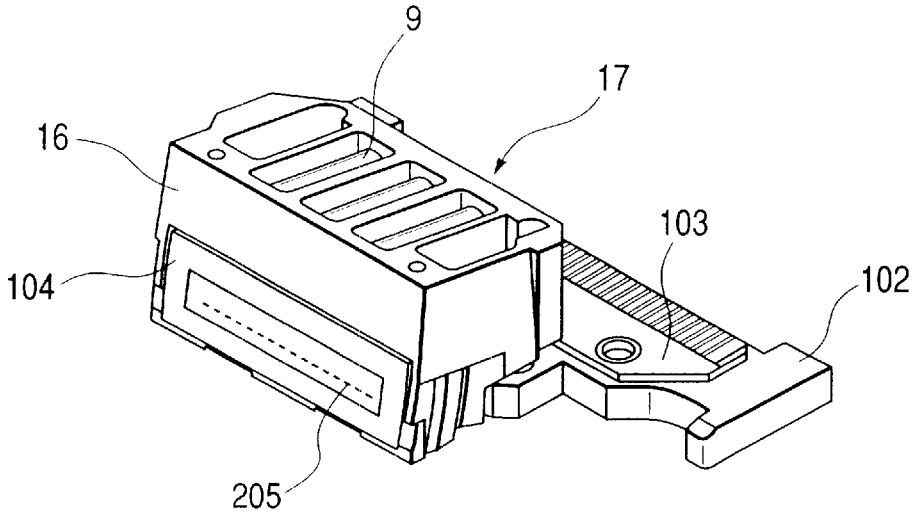
FIG. 19 is an external perspective view of the ink jet recording head shown in FIGS. 1 and 2.
Figure 20:
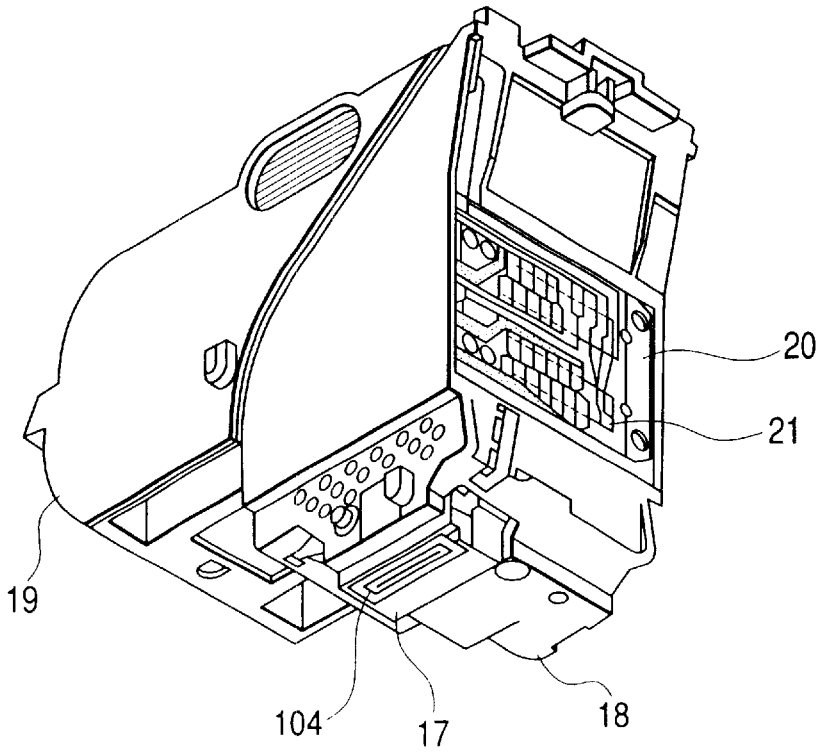
FIG. 20 is an external perspective view of an ink jet cartridge employing the ink jet recording head shown in FIG. 19.

FIG. 19 is an external perspective view of the ink jet recording head shown in FIGS. 1 and 2, and FIG. 20 is an external perspective view of an ink jet cartridge employing the ink jet recording head shown in FIG. 19.

As shown in FIG. 20, the ink jet recording head 17 shown in FIG. 19 is mounted on a support member 18, which is coupled with an ink tank holder 19 whereby the ink in an ink tank mounted on the ink tank holder 19 is supplied to the ink jet recording head 17.

A printed wiring board 103 of the ink jet recording head 17 is connected to a flexible printed wiring board 20 and receives, through contact pads 21 thereon, electrical signals from the main body of the ink jet recording apparatus.

Figure 25:
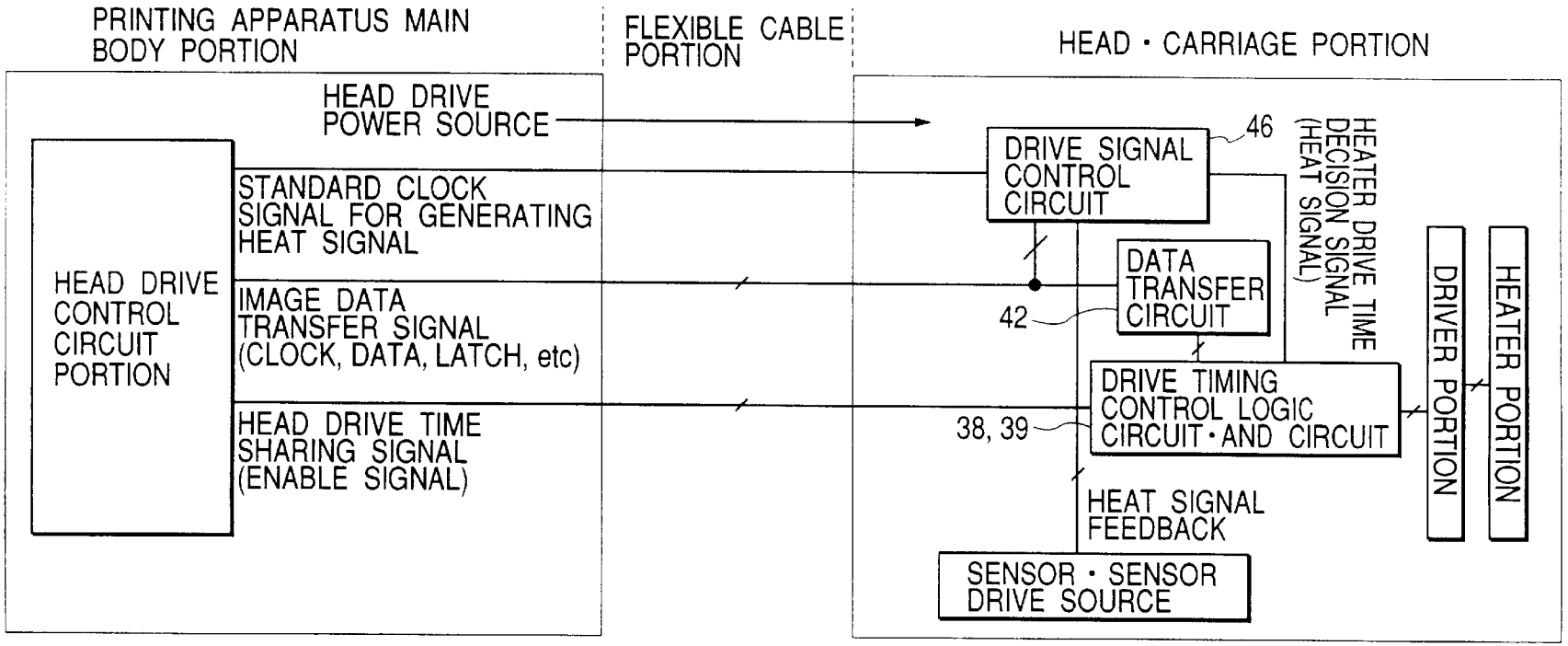
FIG. 25 is a view showing the signal flow in the ink jet recording head of the present invention.

In the following there will be explained the flow of signals in the above-described configuration, with reference to FIG. 25 showing the signal flow in the present embodiment.

A heat driving control circuit of the main body generates a reference input signal to be used for generating heat signals, image data transfer signals such as DCLK, DATA, LATCH etc. to be used for transferring image data and head drive time shearing (time-division) signals (BENBI to n) and sends these signals to the head. The drive signal control circuit generates a heater drive time determination signal by correction according to the information obtained from a sensor and stored in a memory, based on a part of the clock signal and the image data transfer signals, and sends the heater drive time determination signal to a drive timing control circuit and a circuit.

On the other hand, an image data transfer circuit receives the image data transfer signal including the serially entered image data, and outputs the latched image data to the drive timing control circuit and the circuit. The drive timing control circuit and the circuit also receive the head drive time-division signals and drive the ink discharging heaters by these signals.

More specifically, the resistance of the heat generating element is detected by a rank heater and is stored in a memory. The drive signal control circuit determines the upshift and downshift data of the driving pulse signal, including the timing of application thereof, for the heat generating element 32 according to the resistance and the liquid discharge characteristics stored in the memory and sends these data to the circuit. On the other hand, the serially entered image data are stored in a shift register of the image data transfer circuit 42, then latched by a latch signal in a latch circuit and supplied to a circuit 39 through the driving timing control circuit 38. Thus the pulse duration of the heat pulse is determined according to the upshift and downshift data, and the heat generating element 32 is energized with such pulse duration. As a result, the heat generating element 32 in each nozzle is given a substantially constant energy at a desired timing.

In the following there will be given a more detailed explanation on the configuration of the ink flow path.

Figure 5A:
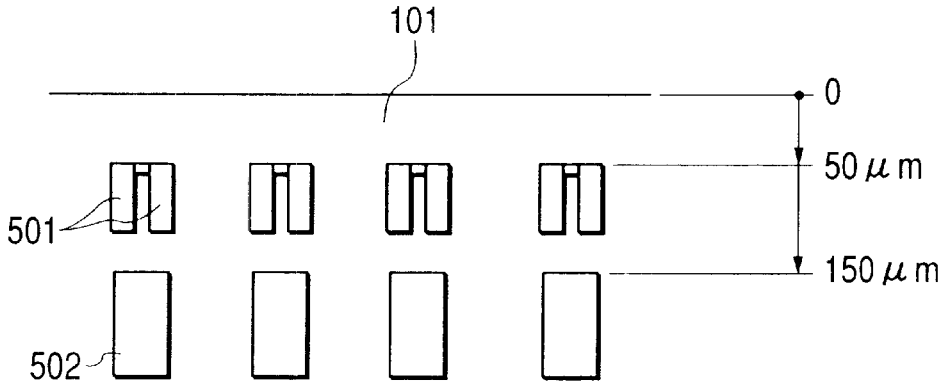
FIGS. 5A and 5B are plan views showing heater positions respectively for color ink and for black ink in the embodiment 1.
Figure 5B:
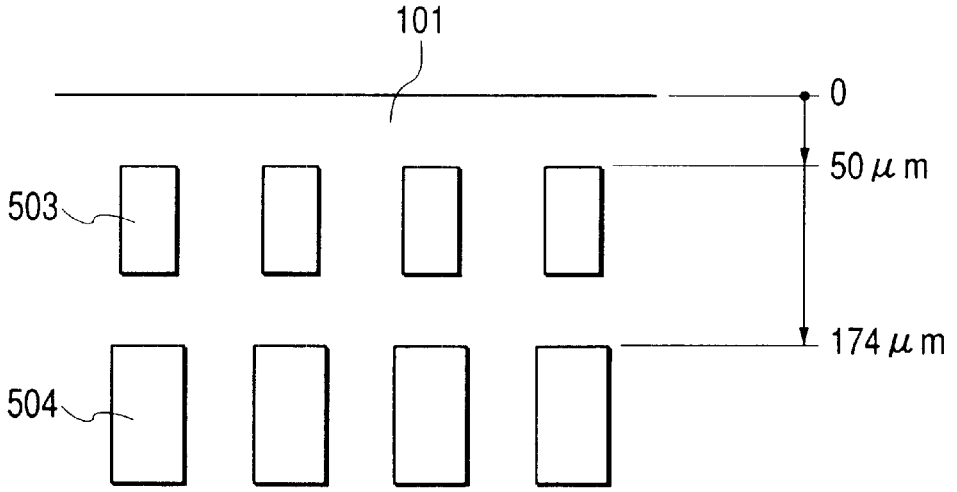

In the present embodiment, independently drivable two heaters are serially positioned along the ink flow path as shown in FIGS. 5A and 5B. There are employed inks of yellow, magenta, cyan and black colors, among which the inks of three colors of yellow, magenta and cyan (hereinafter called "color inks") are principally based on dyes, while the black ink is principally based on pigment. For improving the recording quality, the ink discharge amount per operation is selected larger for the black ink than for the color inks. In the present embodiment, since the discharge amount is different between the color inks and the black ink, the discharge amount for the black ink becomes deficient in case the width of the ink flow path 202 is small, while the discharge speed for the color ink becomes deficient in case the width of the ink flow path 202 is large because of the flow resistance increases.

Figure 4A:
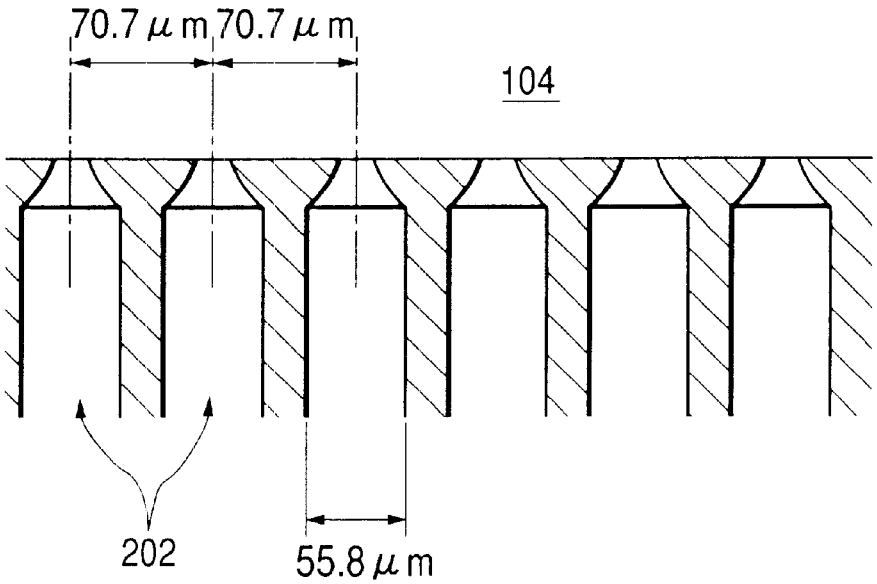
FIGS. 4A and 4B are schematic views showing ink flow paths respectively for color ink and for black ink in the embodiment 1.
Figure 4B:
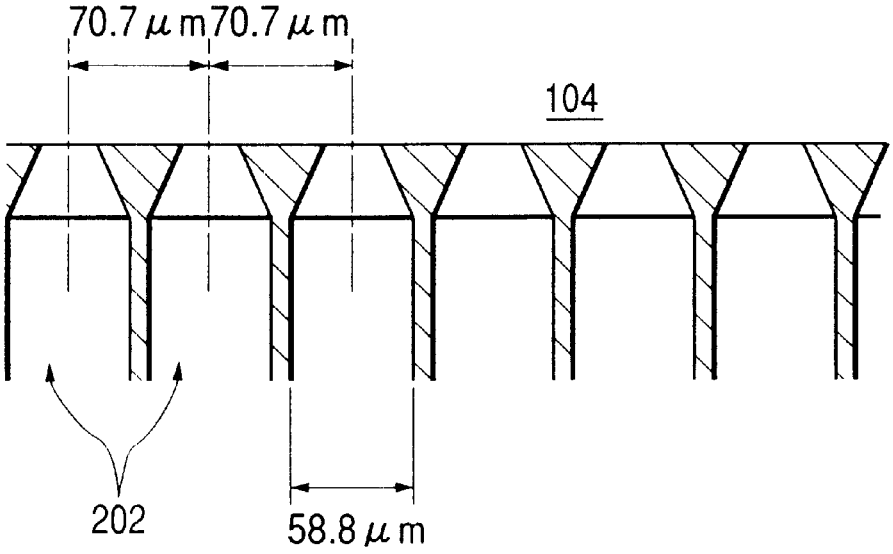

Therefore, for attaining the optimum discharge amount and discharge speed for the respective inks, the ink flow path 202 for the color ink and that for the black ink are designed with different dimensions. More specifically, the ink flow path 202 for the color ink and that for the black ink have different widths. FIGS. 4A and 4B respectively show the ink flow path 202 for the color ink and that for the black ink. The flow path for the color ink has a pitch of 70.7 $\mu$m between the centers of the flow paths and a width of 55.8 $\mu$m, while that for the black ink has a pitch of 70.7 $\mu$m between the centers of the flow paths and a width of 58.8 $\mu$m.

FIGS. 5A and 5B are plan views respectively showing the ink flow path 202 for the color ink and that for the black ink.

The flow path for the color 5 ink having a width of 55.8 μm as explained in the foregoing is provided with a front heater (small heater) 501 at a distance of 50 μm from the discharge port 205 and a rear heater (larger heater) 502 at a distance of 150 μm from the discharge port 205, while that for the black ink having a width of 58.8 μm is provided with a front heater (small heater) 503 at a distance of 50 μm from the discharge port 205 and a rear heater (larger heater) 504 at a distance of 174 μm from the discharge port 205. In the present embodiment, the front heater 501 of the color ink path is longitudinally divided into two and serially connected, but it may also be composed of a single heater as in other heaters 502, 503, 504. Also, the front heater 503 for the black ink flow path is smaller than the front heater 501 (converted into a single heater) of the color ink flow path, and the rear heater 504 of the black ink flow path is smaller than the rear heater 502 of the color ink flow path, through the details are not explained. Such heater configuration also intends to select the discharge amount of the black ink larger than that of the color ink.

Figure 6A:
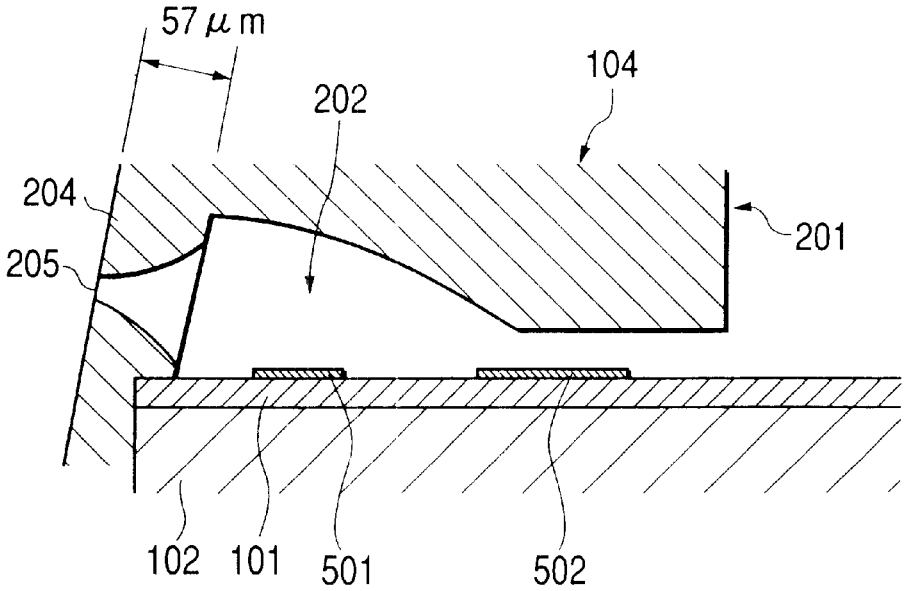
FIGS. 6A and 6B are cross-sectional views showing ink flow paths respectively for color ink and for black ink in the embodiment 1.
Figure 6B:
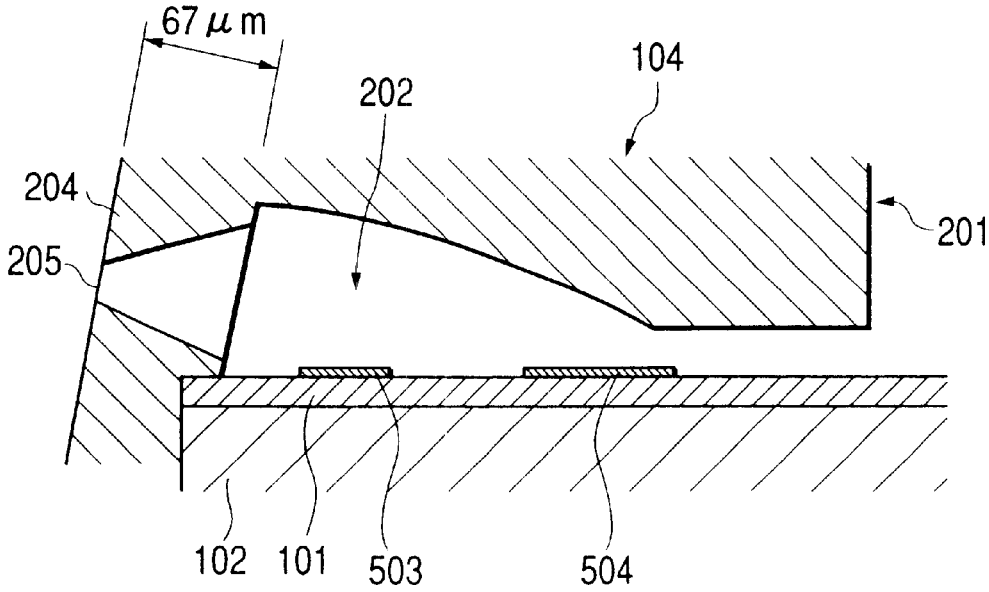

Also in the present embodiment, the orifice plate 204 has different thicknesses in a portion opposed to the ink flow path for the color ink and that opposed to the ink flow path for the black ink. FIGS. 6A and 6B are cross-sectional views along the ink flow path 202 respectively for the color ink and for the black ink.

If the orifice plate 204 has a uniform thickness, the discharge port 205 for the color ink and that for the black ink have a same cross-sectional thickness. In such case, for obtaining a difference in the discharge amount between the color ink and the black ink with a thick discharge port portion, the retraction of meniscus caused by a small liquid droplet of the color ink can be accommodated within the thickness of such discharge port portion but there cannot be obtain a volume required for attaining the desired sufficient discharge amount. On the other hand, if the discharge port portion is thin, the meniscus is retracted to a considerably deep part of the ink flow path 202 in case of discharge of a large liquid droplet of the black ink, thereby requiring a low refilling time.

In the present embodiment, therefore, as shown in FIGS. 6A and 6B, the cross-sectional thickness of the discharge port is made smaller (57 μm) for the color ink and larger (67 μm) for the black ink. Such change in the cross-sectional thickness between the discharge port for the color ink and that for the black ink allows to stabilize the amount of retraction of the meniscus, to adjust the refilling time and to secure the discharge amount even for the small liquid droplet of the color ink.

Figure 7:
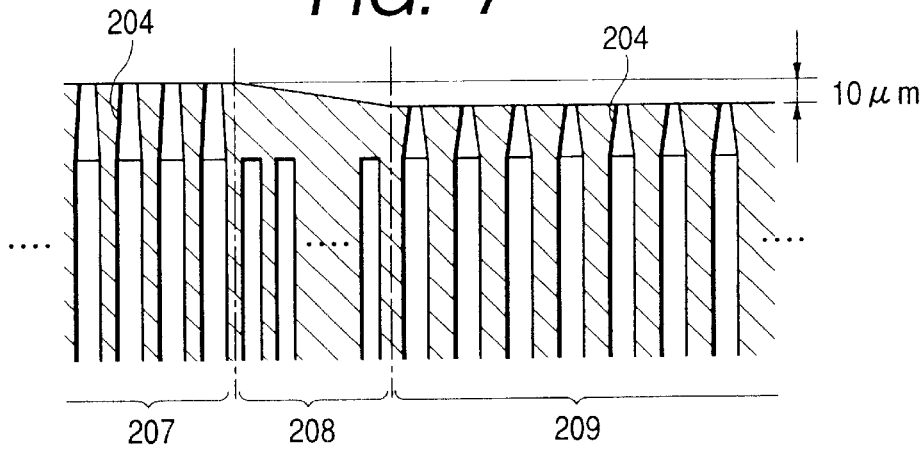
FIG. 7 is a schematic view showing a nozzle group for color ink a nozzle group for black ink and a dummy nozzle group in the embodiment 1.

As the discharge port portion has a difference of 10 μm in thickness between the color ink portion and the black ink portion, there are provided eight dummy nozzles 208, not contributing to the ink discharge, between the color ink nozzle group 209 and the black ink nozzle group 207 as shown in FIG. 7, and the thickness is gradually changed in the portion of such dummy nozzles 208. Because of such configuration, the slope is made less steep, so that, in cleaning the front face of the orifice plate 204 for example with an unrepresented blade, there will not be left remnant.

Figure 8:
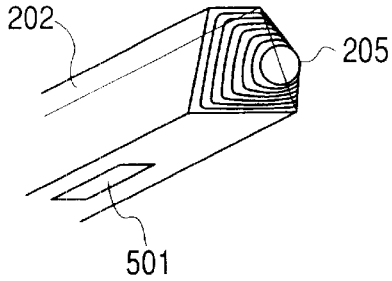
FIG. 8 is a schematic perspective view of an ink flow path and a discharge port for color ink in the embodiment 1.

Also as shown in FIGS. 6A and 6B, the discharge port 205 has different cross-sectional shape for the color ink and for the black ink. The discharge port for the color ink, shown in FIG. 6A, has a cross-sectional shape becoming gradually narrower to the front end. Also as shown in a schematic perspective view in FIG. 8, the ink flow path 202 has a cross-sectional trapezoidal shape with equal legs and the connecting portion between the discharge port 205 and the ink flow path 202 similarly has a trapezoidal shape with equal legs, but the cross-sectional shape of the discharge port 205 gradually changes to a circular shape toward the front end side. Such tapered change of the shape of the discharge port 205 from the trapezoidal shape to the circular shape allows to reduce the fluid resistance in the connecting portion between the discharge port 205 and the ink flow path 202, and to sufficiently secure the volume between the ink flow path 202 and the discharge port 205 at a side of the heater closer to the discharge port 205, thereby improving the refilling property for the color ink of the smaller discharge amount.

Figure 9:
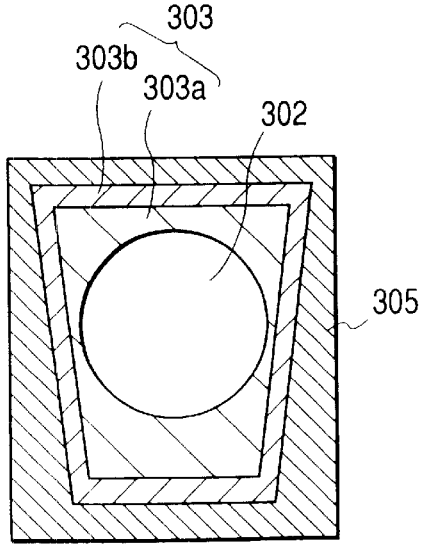
FIG. 9 is a magnified view of a mask for producing the discharge port shown in FIG. 8.

The discharge port of the above-described configuration can be formed by laser working with a mask as shown in FIG. 9, having stepwise light decreasing portions 303*a*, 303*b* between an opaque portion 305 and a light transmitting portion 302. Though FIG. 9 shows only two stepwise light decreasing portions 303*a* and 303*b*, there may be provided the light decreasing portions in three steps or in a larger number of steps.

In the present embodiment, the cross-sectional shape of the ink flow path 202 and that of the connecting portion between the discharge port 205 and the ink flow path 202 are trapezoidal with equal legs, but the cross-sectional shape of the ink flow path 202 is only required to be a rectangle having a bottom at the flat element substrate 101 bearing the heater, and the cross-sectional shape of the discharge port 205 at the connecting part with the ink flow path 202 is only required to be rectangular matching the above-mentioned rectangle.

On the other hand, the cross-sectional shape of the discharge port 205 for the black ink and that at the end of the ink flow path 202 at the side of the discharge port are circular. Thus, different from the discharge port for the color ink, the discharge port 205 for the black ink remains circular. Such difference in the cross-sectional shape between the color ink and the black ink allows to improve the refilling ability for the color ink despite of the difference in the discharge amount.

In general, in using a large heater in such ink jet recording head with a long distance between the discharge port and the heater, the volume of the flow path in front of the center of the heater becomes larger than that behind the center. Then, at the ink refilling by the contraction of the bubble, the fluid resistance in the front portion becomes larger than that in the rear portion so that the ink is refilled more easily from the common liquid chamber 201 at the rear. As a result, the amount of retraction of the meniscus decreases and the ink supply from the rear is executed immediately whereby the refilling time becomes shorter. However, if such refilling is excessive, the meniscus protrudes from the discharge port 205, and, if the next heater driving is started before the meniscus returns to the interior of the discharge port 205, the ink may drip off from the discharge port 205.

Inversely, in case the distance between the discharge port and the heater is made shorter, the volume of the flow path in front of the center of the heater becomes smaller than that behind the center. Therefore, at the ink refilling by the contraction of the bubble, the fluid resistance in the front portion becomes smaller than that in the rear portion so that the ink returns more easily from the discharge port 205 at front. As a result, the amount of retraction of the meniscus increases and the refilling time becomes longer. For this reason, high frequency recording is difficult to achieve and there may be obtained blurred recording with insufficient ink discharge amount.

In particular, for a given distance between the discharge port and the heater, the difference in the amount of meniscus retraction becomes more conspicuous for a larger discharge amount.

Therefore, in case of employing different discharge amount for the color ink and the black ink, the amount of meniscus retraction becomes different between the color ink and the black ink for a same distance between the discharge port and the heater, so that satisfactory printing cannot be obtained if a same frequency is selected for both inks. In consideration of this situation, the present embodiment employs, as explained in the foregoing, different distances between the discharge port 205 and the rear heater 502 or 504 between the color ink flow path and the black ink flow path as shown in FIGS. 5A and 5B. Such positioning of the rear heaters 502, 504 with different distances to the discharge port 205 allows to minimize the difference in the amount of meniscus retraction between the color ink and the black ink, thereby obtaining satisfactory result for the printing in the initial stage. However, these configurations are still insufficient for constantly maintaining the satisfactory print quality in the continuous printing operation.

In the present embodiment, therefore, the drive timings for the front and rear heaters are changed for the color ink and the black ink, in addition to the aforementioned configurations. If same drive timings are employed for the color ink and the black ink, the quality of the printed image varies significantly depending on the kind of the ink. For example, in case the color ink is principally based on dye while the black ink is principally based on pigment, and if the refilling time is short, the color ink may result in dot mis-alignment in solid printing (printing for covering the entire surface of the recording sheet), and there may result dripping of the ink onto the sheet in extreme cases. On the other hand, if the refilling time is long, the solid printing becomes blurred as the refilling cannot be made in time. On the other hand, the black (pigment) ink, having a higher surface tension than in the color ink, does not cause dot mis-alignment in the solid printing even if the refilling time is somewhat short, despite of the large discharge amount. However, in a temperature of about 30° C., the refilling becomes faster to result in a dot mis-alignment of the ruled lines.

Figure 10A:
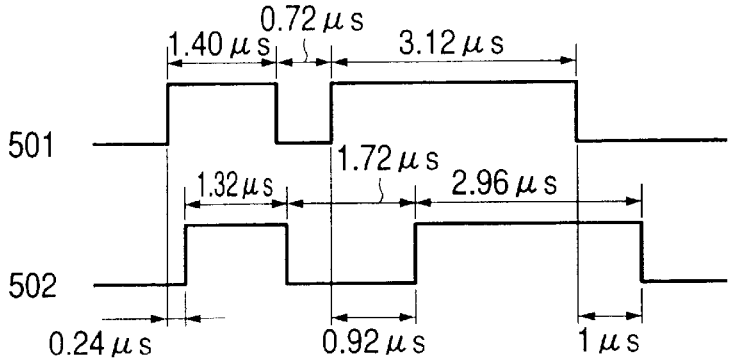
FIGS. 10A and 10B are wave form charts showing the supply timings of the heater driving pulses respectively for color ink (dye) and for black ink (pigment)
Figure 10B:
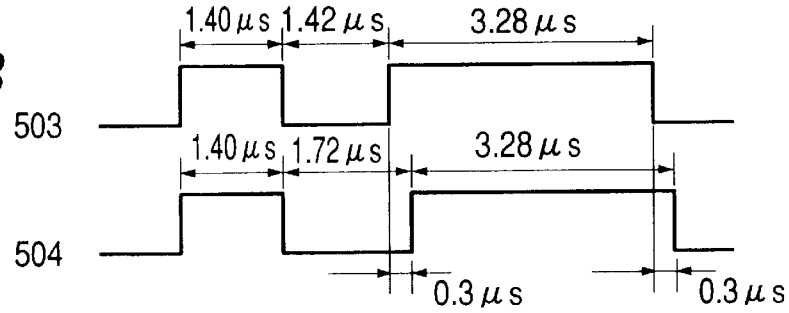

In the present embodiment, therefore, the drive timings for the front and rear heaters are set as shown in FIGS. 10A and 10B for the color ink and the black ink. FIG. 22 shows the discharge amount, the refilling time and the discharge speed in these conditions. In all the following embodiments, each heater is given two driving pulses, but the first supplied pulse is a preliminary drive pulse (signal) which is intended for example to adjust the ink temperature and does not contribute to the ink discharge, while the second supplied pulse is a drive pulse for causing the ink discharge. The present invention is featured by varying the supply timings of the drive signal supplied to the front and rear heaters, but such supply timings relate only to the drive pulses to be supplied later and are not related with the first supplied preliminary drive pulses for ink temperature adjustment.

In the present embodiment employing the color inks based on dyes and the black ink based on pigment, and in the ink flow path 202 for the color ink, after the supply of the ink discharging drive pulse (second supplied pulse) to the front heater 501, the ink supplying drive pulse is supplied to the rear heater 502 with a delay of 0.92 $\mu$s, but, in the ink flow path 202 for the black ink, after the supply of the ink discharging drive pulse (second supplied pulse) to the front heater 503, the ink supplying drive pulse is supplied to the rear heater 504 with a delay of 0.3 $\mu$s. Consequently the supply timing of the drive signal is different by about 0.7 $\mu$s between the rear heater 502 for the color ink and that 504 for the black ink. In this control method, for the color ink, the front heater 501 is activated 0.92 $\mu$s earlier than the rear heater 502 to realize an optimum refilling time of 150 to 200 $\mu$s, thereby avoiding dot mis-alignment after the solid printing or blurred printing. Also for the black ink, the front heater 503 is activated 0.3 $\mu$s earlier than the rear heater 504 to realize an optimum refilling time of 90 to 120 $\mu$s.

Figure 11A:
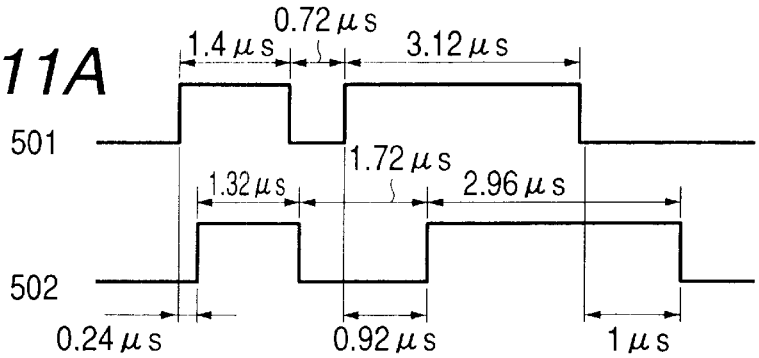
FIGS. 11A and 11B are wave form charts showing the supply timings of the heater driving pulses respectively for color ink (dye) and for black ink (pigment), suitable at a temperature of about 30° C.
Figure 11B:
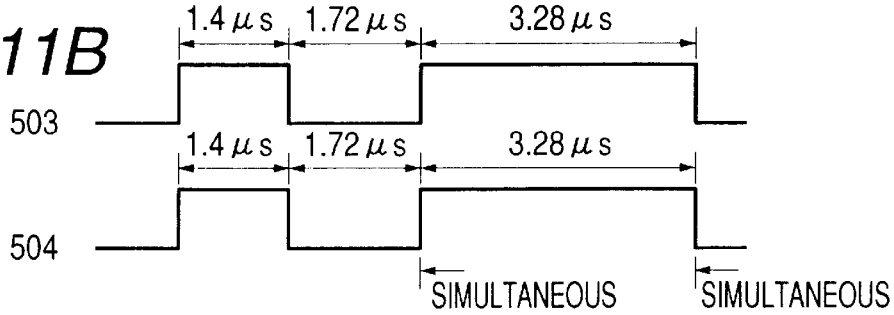

In an environment where the heat temperature becomes about 30° C., the black ink based on pigment, showing a large change in the dispersion stability by the change in temperature, shows an excessively short refilling time and results in a state where the meniscus protrudes from the discharge port. In the present embodiment, therefore, the drive pulses supplied to the heaters 503, 504 for discharging the black ink are changed, from a state at the room temperature where the front heater 503 is activated at first, to a state shown in FIG. 11B where the front heater 503 and the rear heater 504 are activated at the same time. FIGS. 11A and 11B show the drive timings of the front heater and the rear heater respectively for the color (dye) ink and the black (pigment) ink. In this manner the refilling time is delayed to reduce the protrusion of the meniscus and to avoid discharge mis-alignment. Also the discharge amount tends to increase with an increase in temperature, but the above-described control allows to maintain a discharge amount substantially same as that at the room temperature. For the dye ink, the supply timing of the drive signals is changed since the change in the physical properties of the ink as a function of the temperature is smaller than that in the pigment ink. After the head temperature exceeds 30° C., the drive pulses for ink discharge are supplied simultaneously to the front heater 503 and the rear heater 504 and there is executed PWM control of gradually reducing the pulse duration of the preliminary drive pulse in such a manner that the preliminary drive pulse becomes zero when the head temperature reaches 60° C. Such variation of the drive timings of the front and rear heaters toward simultaneous driving with an increase in temperature allows to significantly reduce the dot mis-alignment with the pigment ink resulting from the temperature change thereof, and to obtain a uniform discharge amount.

In the present embodiment, as explained in the foregoing, the drive timings for the front and rear heaters are changed for the color ink and the black ink which are different in the kind and in the discharge amount, in addition to the change in the width of the flow path, the cross-sectional thickness and shape of the discharge port and the distance between the discharge port and the heater, to attain optimum characteristics for the front heaters 501, 503 and the rear heaters 502, 504 for the color ink and the black ink, thereby obtaining satisfactory print quality also in the continuous printing operation. In the foregoing description of the embodiment, there has been explained a specific example of varying the supply timings of the ink discharging drive pulses for the heaters, but the actual supply timings of the ink discharging drive pulses do not necessarily coincide with the values explained in the foregoing and are to be determined in consideration of the pulse duration of the drive pulse and that of the preliminary drive pulses for ink temperature adjustment, which fluctuate depending on various conditions such as the size and performance of the heaters 501, 502, 503, 504, the performance of the power supply, the dimension and shape of various portions of the head including the ink flow paths 202 and of the main body of the recording apparatus, the recording density, the kind of the recording medium, various characteristics of the inks and the environmental temperature. The main principle of the present invention is to adjust the supply timings of the ink discharging drive signals to the heaters so as to adjust the characteristics of the heaters at optimum states thereby attaining the desired refilling speeds for all the inks and obtaining satisfactory print quality also in the continuous printing operation, and the specific timings are appropriately selected regardless of the values described in the foregoing embodiment. This consideration applies also to the following other embodiments. Further, the present invention is to regulate the supply timing of the ink discharging drive signal and the actual setting of such timing can be made by the downshift timing of the drive pulse instead of the upshift timing, but the setting of the downshift timing (at the end of the drive pulse) is substantially same as the setting of the upshift timing (at the start of the drive pulse) since the pulse duration is determined in advance.

Also as the head configuration and the drive control of the present embodiment allow to satisfy the discharge characteristics for various inks, the shape of the common liquid chamber 201 can be maintained same regardless of the kind of the ink. Thus the kind of the ink can be arbitrarily changed within a head. In case of changing the shape of the common liquid chamber 201 according to the kind of the ink, it is necessary to alter the steps or the partial works in the head manufacturing process, but the present embodiment, capable of maintaining the common liquid chamber 201 in a completely identical shape regardless of the kind of the ink to be employed, allows to reduce the number of steps in the manufacturing process, thereby reducing the time and cost thereof.

[Embodiment 2]

In contrast to the embodiment 1 employing the dye-based color inks and the pigment-based black ink, the present embodiment employs color inks and black ink both based on dyes. Also in this case, the discharge amount in one discharge is selected larger for the black ink than for the color inks, in order to improve the recording quality. The configuration of the ink jet recording head, including the dimensions of the ink flow paths, discharge ports and heaters, is identical with that in the embodiment 1.

Figure 12A:
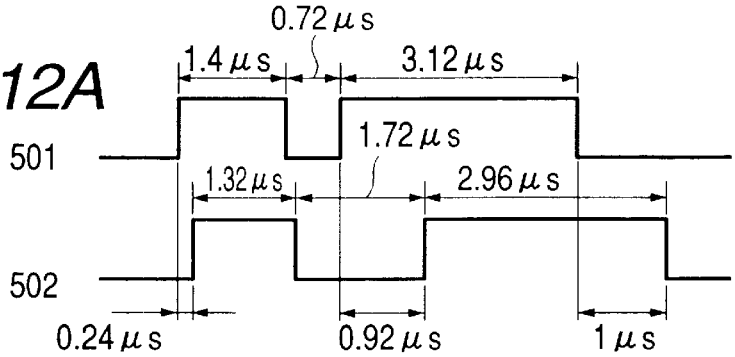
FIGS. 12A and 12B are wave form charts showing the supply timings of the heater driving pulses respectively for color ink (dye) and for black ink (pigment) in an embodiment 2.
Figure 12B:
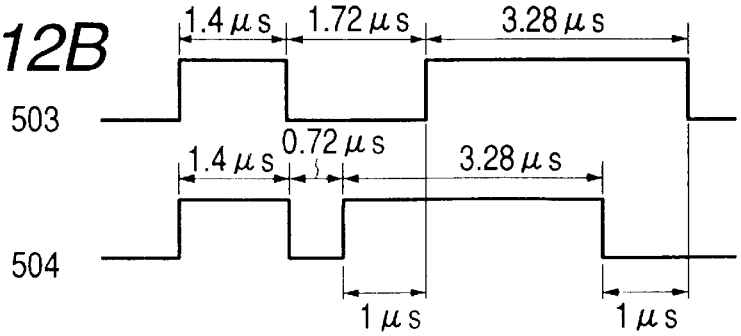

If the heaters for the color ink and the black ink are driven with the same timings in such configuration, the black ink shows a faster refilling speed because of the larger discharge amount, thereby resulting in a dot mis-alignment after the solid printing. In extreme situations, the ink drips onto the recording sheet. Therefore, the supply timings of the ink discharging drive pulses for the front and rear heaters are changed for the color ink and the black ink as shown in FIGS. 12A and 12B.

More specifically, for the color ink, after the supply of the ink discharging drive pulse to the front heater 501, the drive pulse is supplied to the rear heater 502 with a delay of 0.92 $\mu$s. On the other hand, for the black ink, the ink discharging drive pulse is inversely supplied at first to the rear heater 504, and then the drive pulse is supplied to the front heater 503 with a delay of 1 $\mu$s. In this manner the satisfactory printing is possible for the color ink as in the embodiment 1, and, also for the black ink, there is obtained an optimum refilling time of 150 to 200 $\mu$s as shown in FIG. 22, with an increase in the discharge speed closer to that of the color ink, whereby attained is satisfactory printing without dot mis-alignment after solid printing, blurred printing or ink mis-placement.

In the following there will be explained an example of varying the supply timings of the drive signals for the front and rear heaters by the head cartridge.

Figure 21:
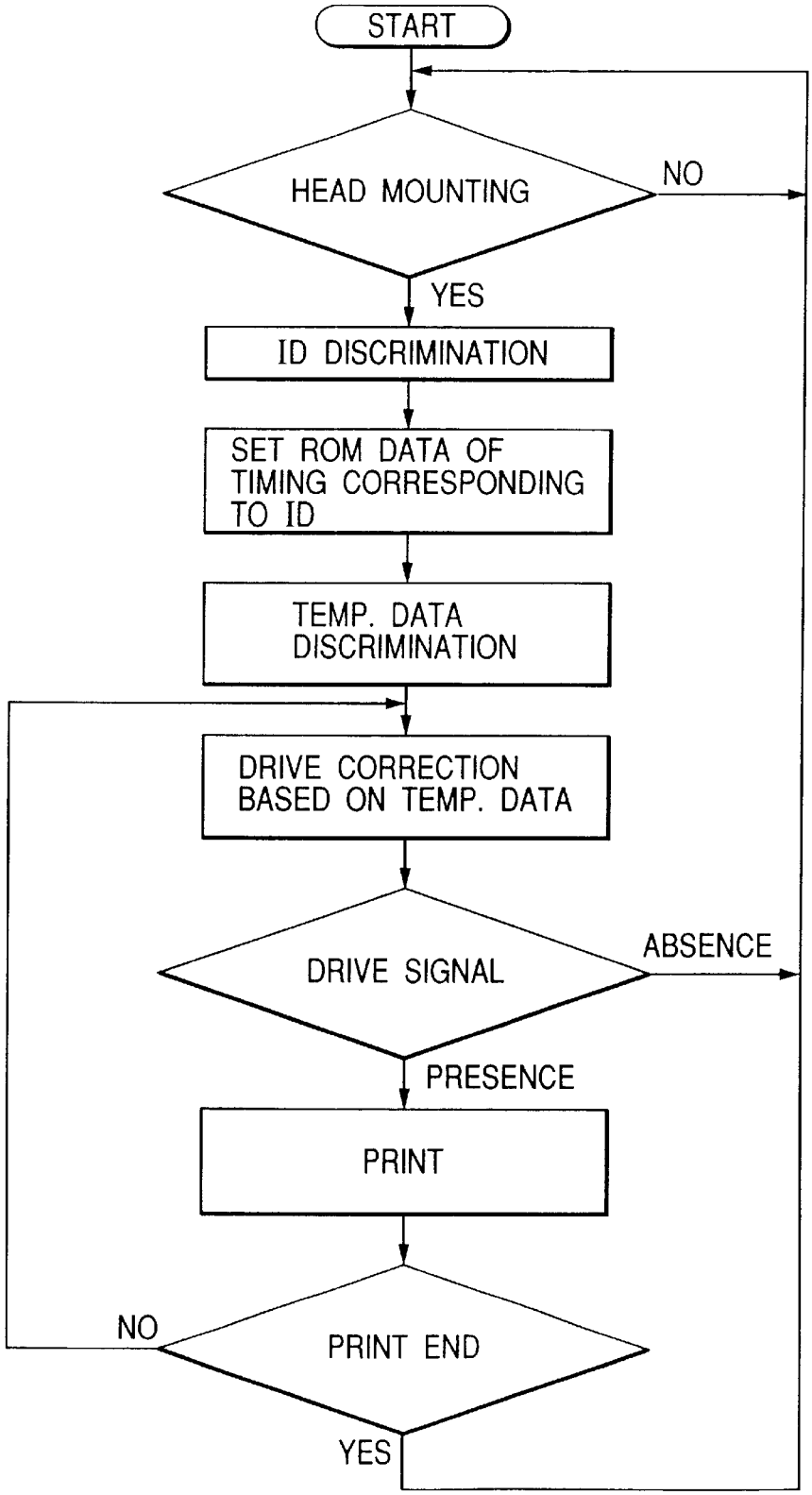
FIG. 21 is a flow chart until the determination of the supply timings of the drive signals at the mounting of the head cartridge.
Figure 23:
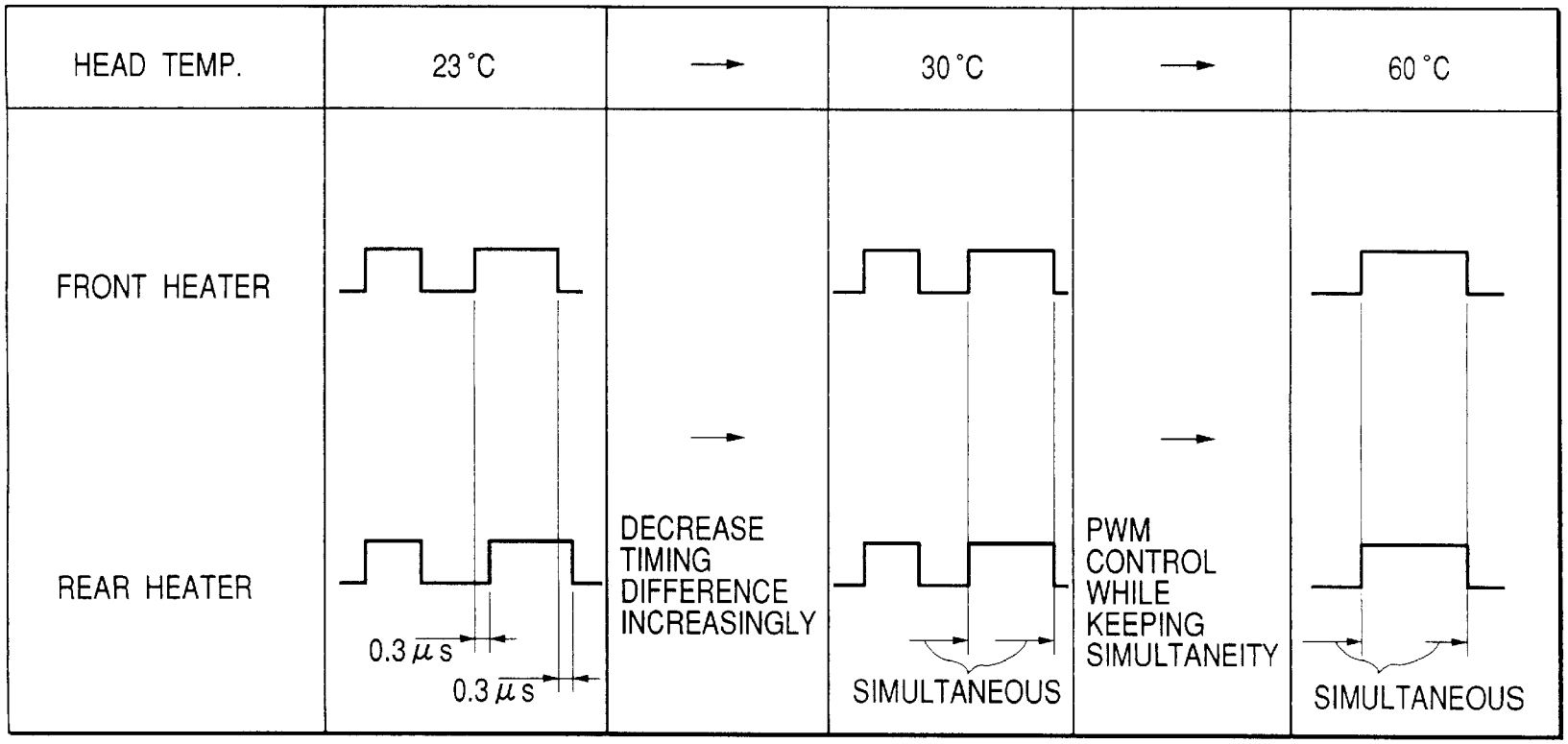
FIG. 23 is a table showing the drive timing for black ink (pigment) with an increase in temperature.
Figure 24:
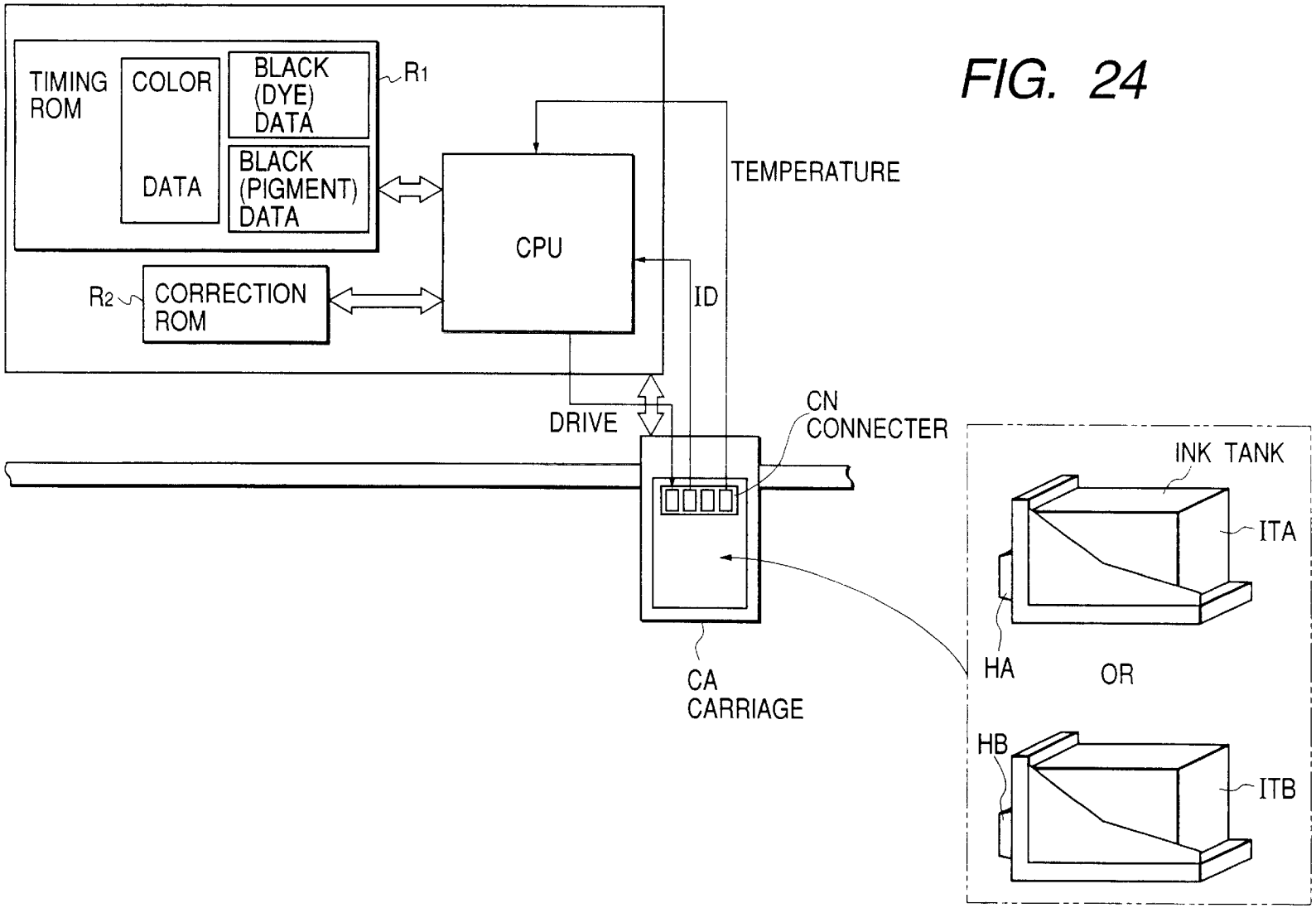
FIG. 24 is a schematic view of the ink jet recording apparatus of the present invention and plural head cartridges selectively and detachably mountable on the apparatus.

FIG. 24 is a schematic view showing the ink jet recording apparatus of the present embodiment and plural head cartridges selectively and detachably mountable to the apparatus, and FIG. 21 is a flow chart showing the process until the determination of the supply timings of the drive signals at the mounting of the head cartridge.

When either of head cartridges HA, HB having a same configuration of the liquid paths and the discharge ports and respectively having ink tanks ITA, ITB containing inks of different properties is mounted on a carriage CA, the apparatus recognizes ID means provided on each head cartridge and judges the ID. The apparatus is provided in advance with plural ROM data for the supply timings of the drive signals for the front and rear heaters corresponding to such ID's, and a CPU selects the ROM data corresponding to the ID judgment (discrimination) and corrects the driving of the heaters according to the temperature data of the head, based on such ROM data. Such configuration allows to maintain the constant discharge amount even when the head cartridge is changed, thereby maintaining satisfactory printing.

In the foregoing description, the ROM data are provided in the apparatus, but they may also provided in each head cartridge, thereby enabling correction in a faster manner.

[Embodiment 3]

The present embodiment is different from the foregoing embodiments in the pattern of a hydrophilic area and a water-repellent area partially provided on the orifice plate 204, but is same in other configurations and the driving method.

Figure 13:
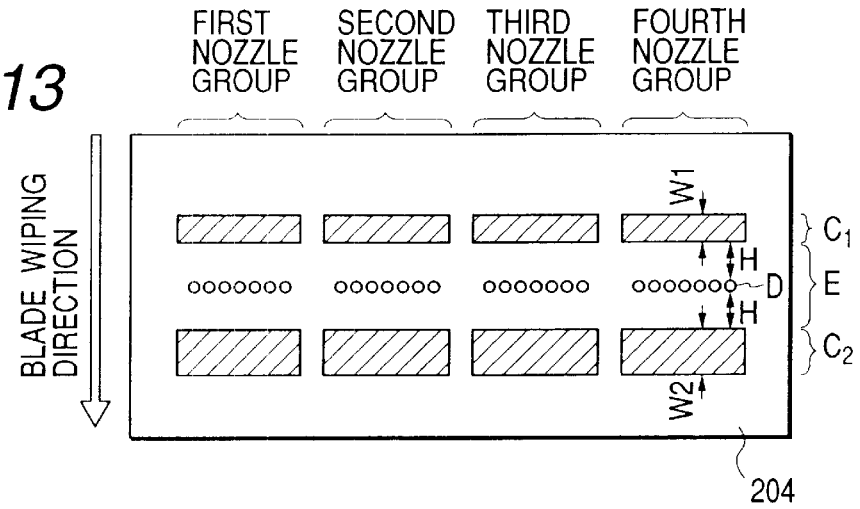
FIG. 13 is a schematic view showing the pattern of a hydrophilic area and a water repellent area on an orifice plate in a embodiment 3.

FIG. 13 shows the pattern of a hydrophilic area and a water-repellent area provided on the orifice plate 204 of the present embodiment. In the present embodiment, in a substantially central area of the orifice plate 204, there are formed four nozzle groups D, from first to fourth groups, each including plural discharge ports 205 at a constant pitch. Around the nozzle groups D, there is formed a central water-repellent area E. In positions above and below and separated by predetermined distances from the nozzle groups D, the first and second hydrophilic areas C1, C2 are formed adjacent to the central water-repellent area E and along the nozzle groups D, and in separate groups respectively corresponding to the nozzle groups D. In the present embodiment, the first and second hydrophilic areas C1, C2 are separated by a distance H of about 35 to 250 $\mu$m from the nozzle groups D and with a width W1 of 400 $\mu$m and a width W2 of 800 $\mu$m.

The first and second hydrophilic areas C1, C2 are formed as stripe-shaped grooves and serve, when the ink deposited outside the hydrophilic areas move toward the inside, to capture such ink in the grooves thereby preventing such ink from reaching the discharge ports. Such groove-shaped hydrophilic areas are formed by laser working after forming a water-repellent film by water-repellent process on the surface of the orifice plate 204 of a resinous material. More specifically, the irradiation of the orifice plate 204 by a laser beam to scrape off the surface thereof thereby eliminating a part of the water-repellent film and forming the hydrophilic area.

As the head configuration same as in the embodiment 1 suppresses the generation of ink mist regardless of the kind of the ink, the area of the hydrophilic areas and the distance to the row of the discharge ports can be maintained constant regardless of the kind of the ink. Thus the kind of the ink can be arbitrarily changed within a head. In case of changing the head of the hydrophilic area and the distance to the row of the discharge ports according to the kind of the ink, it is necessary to alter the steps or the partial works in the head manufacturing process, but the present embodiment, capable of maintaining the constant pattern of the hydrophilic and water-repellent areas regardless of the kind of the ink to be employed, allows to reduce the number of steps in the manufacturing process, thereby reducing the time and cost thereof.

Figure 14:
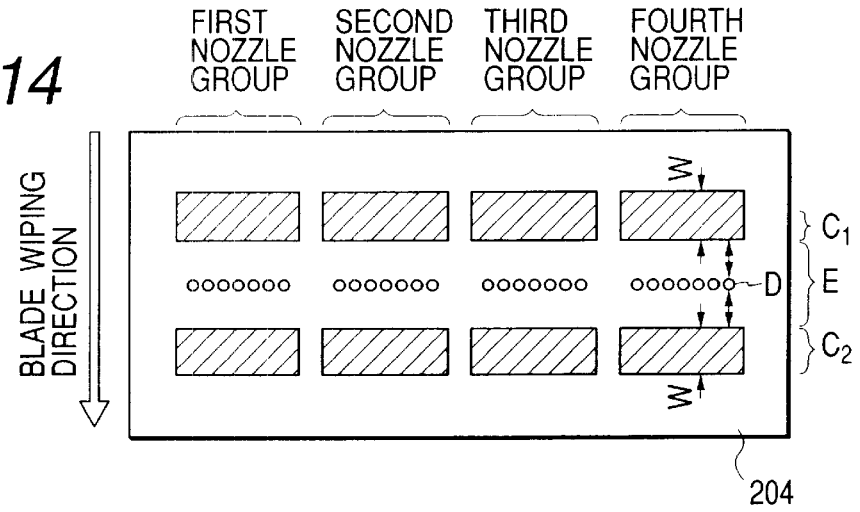
FIG. 14 is a schematic view showing a variation of the embodiment 3.
Figure 15:
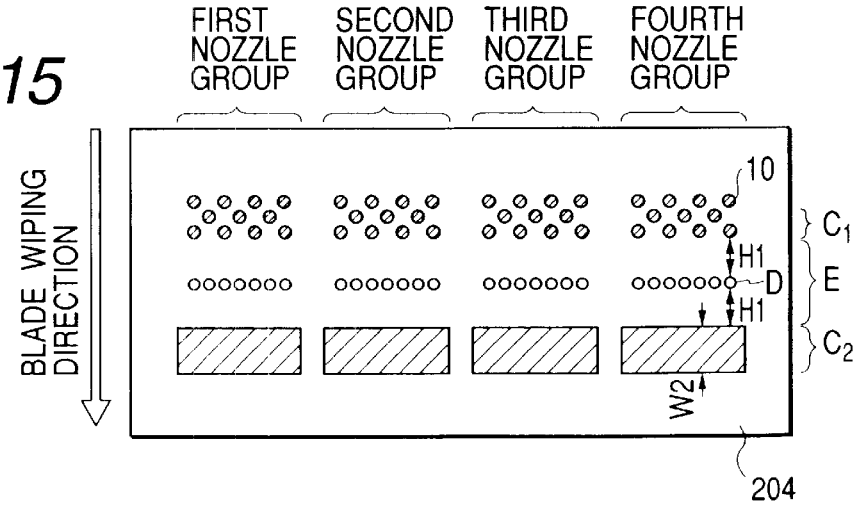
FIG. 15 is a schematic view showing another variation of the embodiment 3.

In the configuration shown in FIG. 13, the width of the first hydrophilic area C1 is made smaller than that of the second hydrophilic area C2, but there may be also assumed a configuration in which the hydrophilic areas C1, C2 have a same width as shown in FIG. 14 or a configuration in which the first hydrophilic area C1 is formed by dot-shaped recesses instead of a groove as shown in FIG. 15.

[Embodiment 4]

The present embodiment is different in the connecting portion between the ink flow path 202 and the common liquid chamber 201, but is substantially same as the foregoing embodiments with respect to other configurations and the driving method.

Figure 16:
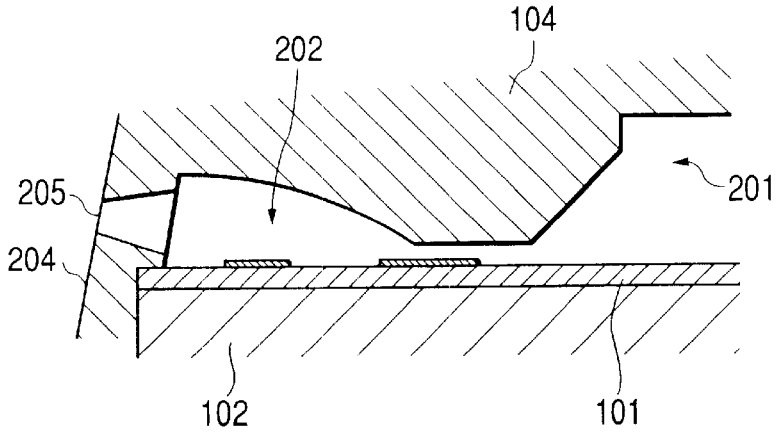
FIG. 16 is a cross-sectional view of an ink flow path in an embodiment 4.

FIG. 16 is a cross-sectional view of the principal part of the head of the present embodiment. In this configuration, the ceiling of the ink flow path 202 has a maximum height of 54 $\mu$m at the side of the discharge port 205, from which the ceiling becomes gradually lower in a hone shape toward the common liquid chamber 201 to a minimum height of 22 $\mu$m at a distance of 300 $\mu$m along the ink flow path 202 from the front end thereof. Then a portion with a constant height (22 $\mu$m) continues to a position of 330 $\mu$m from the front end, and the ceiling then rises linearly upward to 60 $\mu$m at a distance of 380 $\mu$m where the flow path is connected to the common liquid chamber 201.

Figure 17:
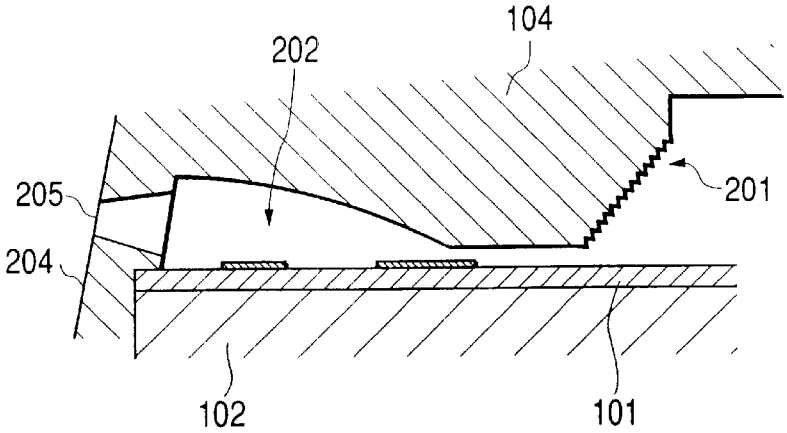
FIG. 17 is a cross-sectional view of the ink flow path in a variation of the embodiment 4.

Also the connecting portion between the link flow path 202 and the common liquid chamber 201 may become higher stepwise as shown in FIG. 17, instead of linearly becoming higher as shown in FIG. 16.

Figure 18:
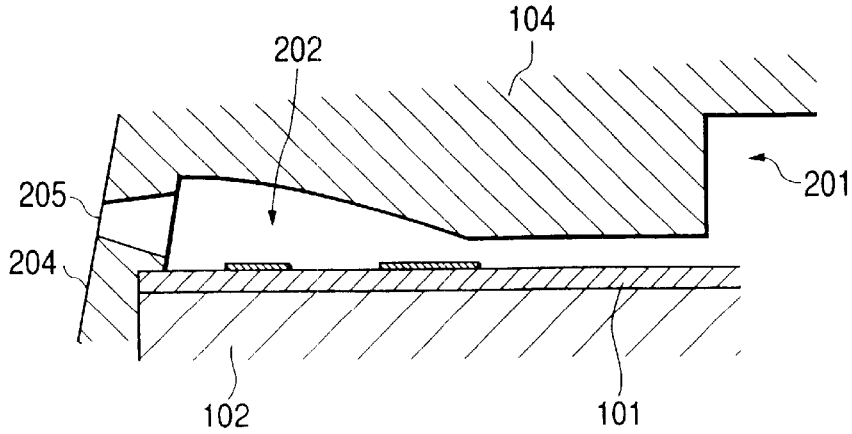
FIG. 18 is a cross-sectional view of a conventional ink flow path.

In case the ink flow path 202 is connected directly from a thin rear end portion (with a low ceiling) to the common liquid chamber 201 as in the conventional configuration shown in FIG. 18, there is generated a large step difference between the two. In such configuration, in case of discharging a large liquid droplet from the discharge port 205, a part of the generated bubble overflows from the rear end of the ink flow path 202 and enters the common liquid chamber 201, and, in the succeeding ink refilling stage, such overflowing portion of the bubble is ripped off by the eddy current generated at the step difference and remains in the front end area of the common liquid chamber 201. The bubble, remaining in the vicinity of the connecting portion of the common liquid chamber 201 with the ink flow path 202, grows by the repetition of the above-described process and eventually intercepts the ink flow, thereby rendering the ink discharge impossible. On the other hand, the relative smooth connection between the ink flow path 202 and the common liquid chamber 201 as shown in FIGS. 16 and 17 reduces the step difference, thereby reducing the eddy current at the step difference. It is thus rendered possible to reduce the bubble remaining in the vicinity of the connecting portion between the common liquid chamber 201 and the ink flow path 202, thereby avoiding the disabled ink discharge.

The configuration of the ink jet recording head of the embodiment 1 allows to satisfy all the discharge characteristics of all the inks, thereby allowing to maintain the shape of the ink flow path 202 constant regardless of the kind of the ink. Thus the kind of the ink can be arbitrarily changed within a head. In case of changing the shape of the ink flow path 202 according to the kind of the ink, it is necessary to alter the steps or the partial works in the head manufacturing process, but the present embodiment, capable of maintaining the ink flow path 202 in a completely identical shape regardless of the kind of the ink to be employed, allows to reduce the number of steps in the manufacturing process, thereby reducing the time and cost thereof.

Figure 26:
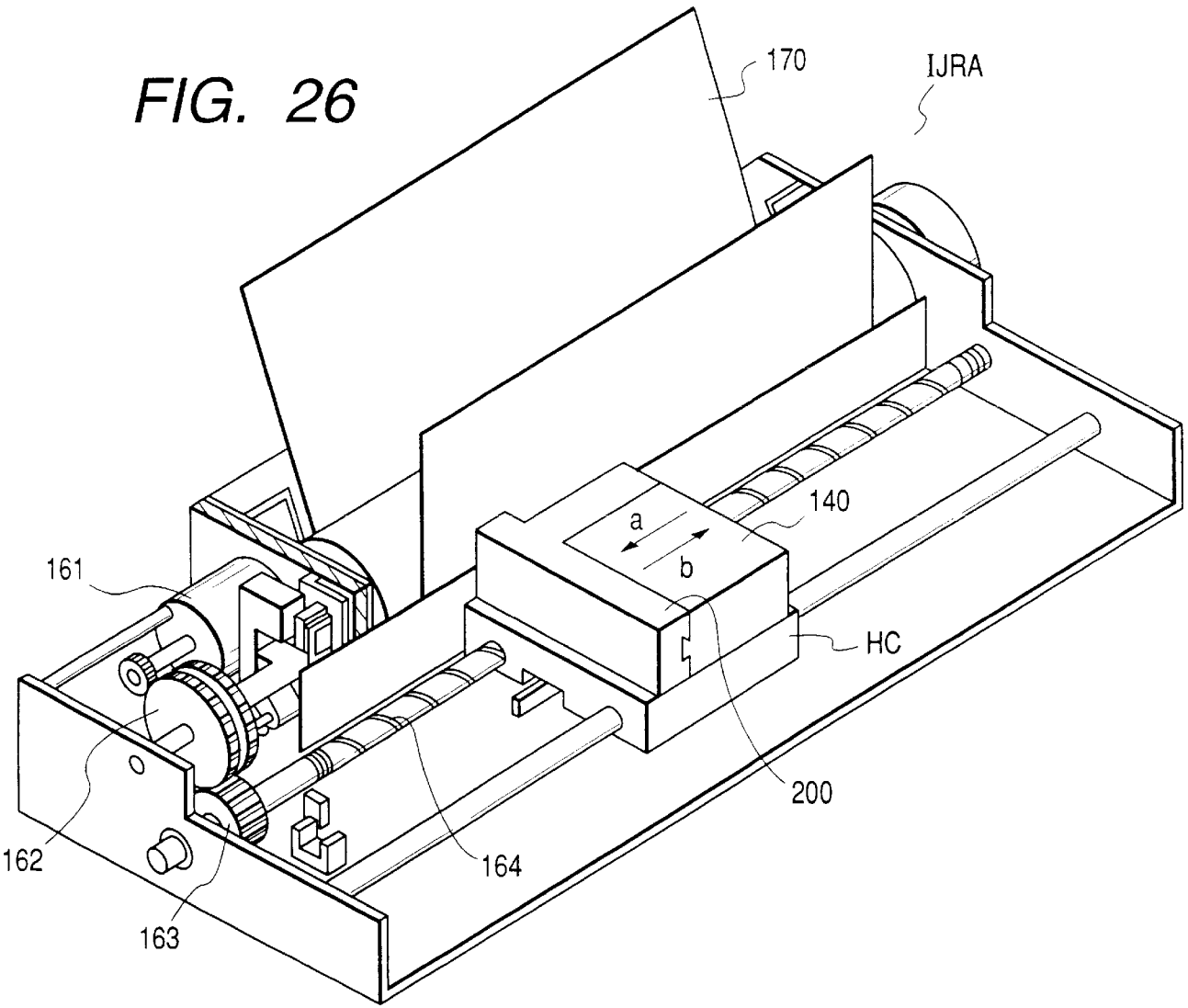
FIG. 26 is a schematic view showing the ink jet recording apparatus of the present invention.

FIG. 26 schematically shows the configuration of an ink jet recording apparatus employing the ink jet recording head described in the foregoing. The present embodiment will be explained in particular by an ink jet recording apparatus IJRA employing inks as the discharge liquids. A carriage (scanning device) HC of the ink jet recording apparatus supports a head cartridge detachably including a liquid container 140 containing ink and a liquid discharge head portion 200, and executes a reciprocating motion in the transversal direction (indicated by arrows a, b) of a recording medium 170 such as recording paper which is conveyed by recording medium conveying means. The liquid container and the liquid discharge head portion are so constructed as to be mutually separable.

When a drive signal is supplied from drive signal supply means, not shown in FIG. 26, through a flexible cable to the liquid discharge means on the carriage HC, the liquid discharge head portion 200 in response discharges liquid onto the recording medium 170.

The ink jet recording apparatus of the present embodiment is also provided with a motor 161 as the drive source for driving the recording medium conveying means and the carriage HC, gears 162, 163, a carriage shaft 164 etc. for transmitting the power from the drive source to the carriage HC.

What is claimed is:

1. An ink jet recording apparatus including an ink jet recording head provided with a discharge port for discharging ink, an ink flow path communicating with said discharge port, and at least two heat generating elements provided in said ink flow path along the direction thereof, wherein said ink is pigment-based ink and said recording head comprises drive signal supply means for varying the supply timing of drive signals to said plural heat generating elements for ink discharge in such a manner that the drive signal is at first given to the heat generating element at the side of the discharge port at room temperature and the supply timings to said plural heat generating members become simultaneous or closer thereto with an increase in the temperature of the recording head.

2. An ink jet recording apparatus according to claim 1, wherein said drive signal includes a preliminary drive signal and a main drive signal.

3. An ink jet recording apparatus including an ink jet recording head provided with plural discharge ports for discharging ink, plural ink flow paths respectively communicating with said plural discharge ports, and at least two heat generating elements provided in each of said ink flow paths along the direction thereof, wherein said ink jet recording head comprises a pigment-based ink discharge portion for discharging pigment-based ink and a dye-based ink discharge portion for discharging dye-based ink, and said ink jet recording apparatus comprises drive signal supply means for varying the supply timings of drive signals for ink discharge to said plural heat generating elements of the pigment-based ink discharge portion in such a manner that the drive signal is at first given to the heat generating element at the side of the discharge port at room temperature and the supply timings to said plural heat generating members become simultaneous or closer thereto with an increase in the temperature of the recording head.

4. An ink jet recording apparatus according to claim 3, wherein said drive signal includes a preliminary drive signal and a main drive signal.

* * * * *

UNITED STATES PATENT AND TRADEMARK OFFICE

CERTIFICATE OF CORRECTION

PATENT NO. : 6,471,321 B1
DATED : October 29, 2002
INVENTOR(S) : Kiyomi Aono et al.

It is certified that error appears in the above-identified patent and that said Letters Patent is hereby corrected as shown below:

Title page,
Item [*] Notice, "14 days." should read -- 0 days --.
Item [56], References Cited, FOREIGN PATENT DOCUMENTS,
"EP 719647 3/1996" should read -- EP 0 719 647 3/1996 --;
"EP 816085 1/1998" should read -- EP 0 816 085 1/1998 --; and
"JP 355132259 10/1980" should read -- JP 55-132259 10/1980 --.

Column 1,
Line 29, "there" should read -- it --.

Column 2,
Line 43, "communication" should read -- communicating --.

Column 3,
Line 60, "have" should read -- having --; and
Line 66, "provides" should read -- provide --.

Column 4,
Line 28, "ink" (both occurrences) should read -- ink, --; and
Line 48, "a embodiment" should read -- an embodiment --.

Column 6,
Line 39, "independently" should read -- two independently --; and
Line 39, "two" should be deleted.

Column 7,
Line 1, "5" should be deleted;
Line 17, "through" should read -- though --; and
Line 35, "obtain" should read -- obtained --.

Column 8,
Line 36, "despite of" should read -- despite --.

Column 9,
Line 36, "of the" should read -- the --.

UNITED STATES PATENT AND TRADEMARK OFFICE

CERTIFICATE OF CORRECTION

PATENT NO. : 6,471,321 B1
DATED : October 29, 2002
INVENTOR(S) : Kiyomi Aono et al.

It is certified that error appears in the above-identified patent and that said Letters Patent is hereby corrected as shown below:

Column 12,
Line 19, "provided" (2nd occurrence) should read -- be provided --.

Signed and Sealed this

Twenty-first Day of June, 2005

JON W. DUDAS
*Director of the United States Patent and Trademark Office*